US005768960A

United States Patent [19]

Archuleta

[11] Patent Number: 5,768,960

[45] Date of Patent: Jun. 23, 1998

[54] LOCKING SWIVEL HEAD RATCHET WRENCH

[76] Inventor: Tarue David Archuleta, 2932 Lawn Ct., Merced, Calif. 95348

[21] Appl. No.: 775,517

[22] Filed: Jan. 2, 1997

Related U.S. Application Data

[63] Continuation of Ser. No. 570,398, Dec. 11, 1995, abandoned.

[51] Int. Cl.[6] ..... B25B 23/16

[52] U.S. Cl. ..... 81/177.8; 403/84

[58] Field of Search ..... 81/177.8, 177.9, 81/177.7, 185, DIG. 11; 403/84, 87, 102, 103

[56] References Cited

U.S. PATENT DOCUMENTS

| | | | |
|---|---|---|---|
| 2,921,773 | 1/1960 | Hoelzer | 403/103 |
| 4,027,558 | 6/1977 | Fish | 81/185 |
| 4,463,632 | 8/1984 | Parke | 81/177.9 |
| 4,711,145 | 12/1987 | Inoue | 81/177.8 |
| 4,836,067 | 6/1989 | Rogers et al. | 81/185 |
| 4,901,608 | 2/1990 | Shieh | 81/177.8 |
| 4,926,685 | 5/1990 | Shannon, Sr. | 403/84 |
| 5,199,335 | 4/1993 | Arnold et al. | 81/177.8 |

*Primary Examiner*—Eileen P. Morgan
*Assistant Examiner*—Joni B. Danganan
*Attorney, Agent, or Firm*—Kenneth J. Hovet

[57] ABSTRACT

A tilt head wrench is provided having a handle with spaced-apart first and second openings each having a different geometrical shape. A tilt head includes a connector part through which extends a connector opening having a third geometrical configuration. A connector shaft extends through the first, second and connector openings. It includes a first end portion having a cross-sectional configuration that is engageable with the first opening and connector opening. The shaft includes a second end portion that is circular and permits free rotation of the head when positioned within the connector opening and second opening. Selective axial positioning of the connector shaft allows the tilt head to be in a locked or unlocked disposition.

16 Claims, 2 Drawing Sheets

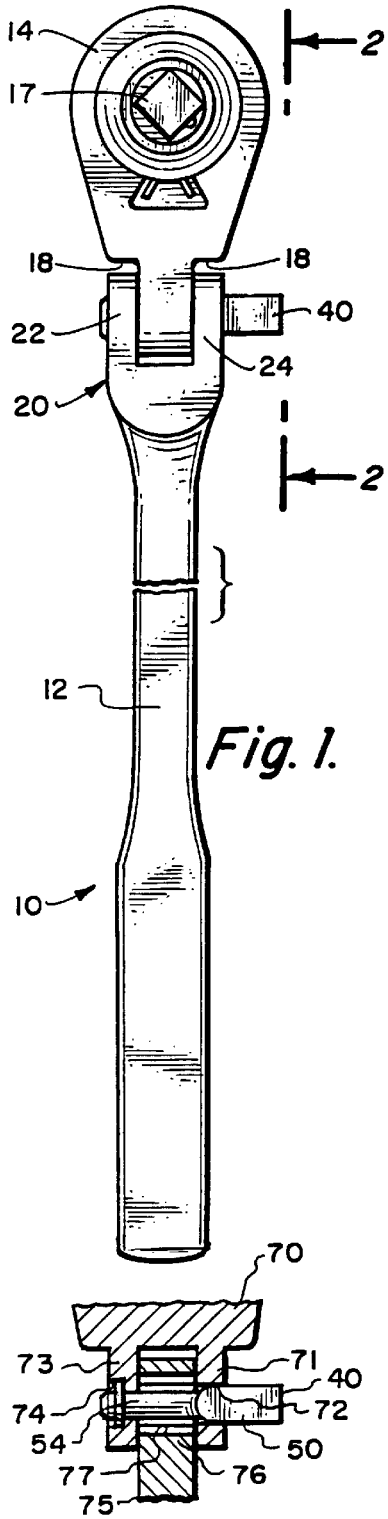
Fig. 1.
Fig. 11.
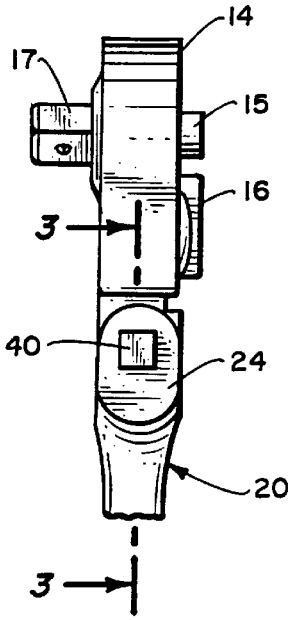
Fig. 2.
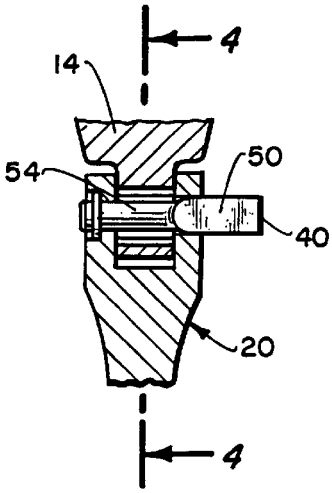
Fig. 3.
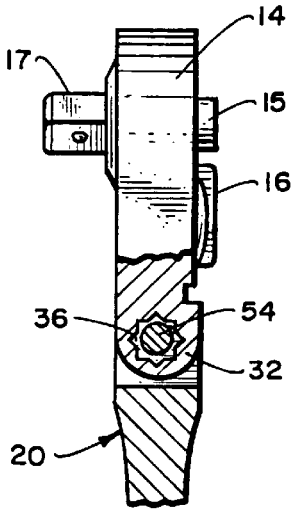
Fig. 4.
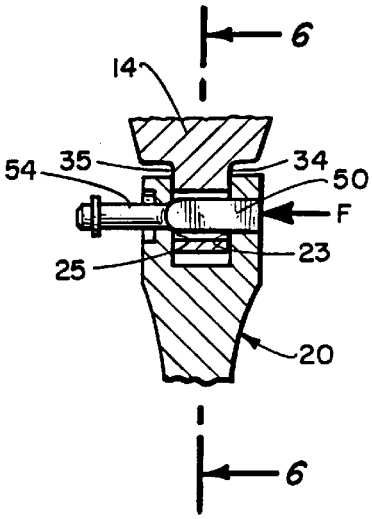
Fig. 5.

LOCKING SWIVEL HEAD RATCHET WRENCH

This application is a continuation of application Ser. No. 08/570,398, filed Dec. 11, 1995, abandoned.

BACKGROUND OF THE INVENTION

1. Field of the Invention

The present invention relates to hand tools and, more particularly, to a wrench with a rotatable head that can be locked in place.

2. Description of the Prior Art

U.S. Pat. No. 5,199,335 discloses a ratchet wrench that includes a tiltable ratchet head. The head includes a hub having teeth that engage corresponding teeth on a rotatable spool. The spool includes a flattened side which, when juxtaposed against the hub teeth allows the ratchet head to freely rotate. Once the head is positioned at the desired angle, the spool is rotated so that the teeth engage the hub teeth and thereby secure the ratchet head.

A serious defect with the above arrangement is that the spool presents a narrow circular periphery. Likewise, the ratchet head hub has a short radius of curvature. When the spool and hub teeth are engaged, only a small section of one or two teeth become engaged. This results in a very weak connection which is readily broken under typical wrench user conditions.

U.S. Pat. No. 4,901,608 also discloses a tiltable ratchet head that includes an outwardly extending hub having teeth about its periphery. A yoke is provided at the end of the wrench handle having a gear which can be reciprocated in and out of contact with the hub gear teeth. When the ratchet head is positioned at the desired angle, the gear is slid into engagement with the corresponding teeth on the hub to lock the hub in place.

The above assembly does not provide a strong geared connection. In fact, only one hub gear tooth engages the groove between a pair of adjacent handle gear teeth. Under the strong torque conditions of typical ratchet wrench use, it is clear that the aforementioned gear connections are inadequate.

SUMMARY OF THE INVENTION

The present invention provides a tilt head and wrench handle which can be rotated relative to each other. They are connected by a hinge means and the angular orientation between the parts may be releasably secured by a locking means. The locking means encompasses the engagement of corresponding surfaces between a connector shaft and associated tilt head and handle openings.

The wrench handle attachment end may be provided with first and second openings having contrasting geometrical configurations. The tilt head includes a connector part also having a connector opening of a predetermined geometrical configuration.

A connector shaft, which is axially slidable within the aforesaid openings, hingably connects the handle to the tilt head. The shaft is provided with a first portion having a cross-sectional configuration that is engageable with the connector and first openings. The shaft includes a second portion which is not rotatably engageable with any of the openings. When positioned within at least the connector opening and second opening, it functions as a hinge pin to permit the free rotation of the tilt head.

When the tilt head is rotated to the desired angular orientation, the connector shaft is moved axially to displace the second shaft portion from its position within the connector and second opening. Simultaneously, the first shaft portion will move into position within the connector opening and first opening whereby multiple surfaces of the first shaft portion cross-section will engage adjacent surfaces of the aforementioned connector and first openings. The tilt head will thereby be prevented from further rotation. Therefore, instead of securing the angular rotation of a tilt head by the mere engagement of one gear tooth in the groove of an opposing pair of teeth, the invention provides an axially reciprocating shaft providing multiple geometrical surfaces for distributing onto a wider surface area the high stress associated with the use of socket wrenches.

In an alternative embodiment, the wrench handle may have an attachment means with a single attachment opening. In such case, the tilt head connector part will be replaced with spaced-apart first and second head openings having contrasting geometrical configurations. In all other ways, the cooperating relationships between the openings and shaft portions remain the same.

BRIEF DESCRIPTION OF THE DRAWINGS

FIG. 1 is a bottom plan view of an overall tilt head wrench that embodies the present invention.

FIG. 2 is a fragmentary side elevational view of the upper end of the wrench taken along lines 2—2 of FIG. 1.

FIG. 3 is a cross-sectional view taken along lines 3—3 of FIG. 2.

FIG. 4 is a fragmentary partial cross-sectional view taken along lines 4—4 of FIG. 3.

FIG. 5 is a view similar to FIG. 3 showing the connector shaft of the invention in a locking position.

FIG. 11 is a fragmentary cross-sectional view similar to FIG. 3 showing proximal end structures on the tilt head and handle reversed from that shown in FIGS. 1–10.

DESCRIPTION OF THE PREFERRED EMBODIMENTS

Figure 6:
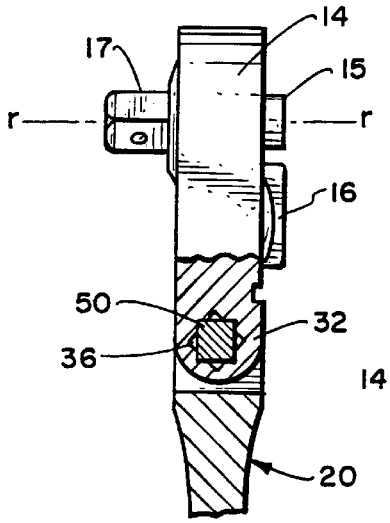
FIG. 6 is a partial fragmentary cross-sectional view taken along lines 6—6 of FIG. 5.

The invention has applicability to any type of tool in which use of a tiltable head is desired. The most common application is in association with a ratchet head wrench such as that shown by reference 10 in FIG. 1. As depicted, the ratchet wrench includes an elongated handle 12 to which is hingedly attached a tilt head 14. The head includes a socket release button 15, a ratchet lock lever 16 and a socket lug 17 which is used for releasably engaging different sized sockets (not shown).

The handle of the ratchet wrench typically comprises an elongated structure having a tilt head attachment end 20. As shown, the attachment end includes axially extending flanges comprising first flange 24 and second flange 22. The flanges are preferably mirror images of each other and include respective inside wall surfaces shown by references 23,25.

The first flange is provided with a first opening 26 having a first geometrical shape. The second flange has a second opening 28 that is provided with a second geometrical shape. The center axis of each opening are in alignment and the flanges are spaced apart a predetermined distance to define an open slot 30 in the handle attachment end.

As shown in the drawings, the center axes of the first and second openings, the longitudinal axis of handle 12 and the rotational axis r,r of socket lug 17 all extend in orthogonally different directions. In particular, the center axes x,x of the first and second openings are about perpendicular to the longitudinal axis of the wrench handle. They are also about perpendicular to the rotational axis r,r of socket lug 17.

The tilt head 14 is provided with an outwardly extending connector part 32. This part extends from inwardly offset shoulders 18 and has an axial extent sufficient to fill most of slot 30. It is defined by opposing sidewalls 34,35 which include respective bearing faces to facilitate a smooth rotational movement against the flange inside walls 23,25.

Extending through the connector part is connector opening 36. The connector opening center axis is preferably about perpendicular to axis r,r of the socket lug. It is aligned to be coextensive with axis x,x of the flange openings. The connector opening may also be characterized as a third opening having a third geometrical configuration.

The tilt head is connected to the attachment end of the handle by extending connector shaft 40 through the flange and connector part openings. The shaft is sized to enable a predetermined portion of its length to reciprocate into and out of any one or more of the aforementioned openings. To ensure that the shaft is not entirely dislodged from the openings, it may be provided with a retention means shown as snap ring 46. The snap ring engages groove 47 proximate one end of the connector shaft. The retention means also comprehends the use of an enlarged head at an opposing end of the connector shaft (not shown).

To selectively lock or unlock the ratchet head, the shaft is provided with first end portion 50 and second end portion 54. Preferably, each end portion has a predetermined axial extent sufficient to comprise the overall length of the shaft. The first and second end portions include respective locking means and release means for the assembly.

The first end portion has a cross-sectional configuration that provides a locking means for engagement with corresponding shapes of the first opening 26 and connector opening 36. The locking means comprises multiple edges, corners and mating surfaces which are engageable between the inner surfaces of the openings and the outer surfaces of the first end portion. Effective locking engagement is readily attainable with corresponding polygonal-shaped structures that provide outer corners 51 on the first end portion for engagement with respective inside corners 52 and 53 of the first opening and connector opening. Other matching geometrical shapes such as curved or undercut structures could also be used.

To effect a strong secure engagement, the overall distance between opposing corners of the shaft should be about equal to the corresponding overall diameter between opposing inside corners of the openings. In this regard, note that it is not required that first opening 26 have a geometrical shape identical to the connector opening 36. It is only important that the outermost engagement structure of the first end portion effectively engage at least portions of corresponding inside structure of the first opening and connector opening.

The second end portion 54 provides a hinge function for the connector shaft. It has a cross-sectional configuration that corresponds to the shape of second opening 28. As shown, the cross-sectional shape of the second end portion is circular, as is the geometrical configuration of the second opening. The diameter of each respective configuration is preferably about equal to provide a wobble-free hinged connection while also permitting a smooth reciprocation of the shaft within the aforementioned openings.

With reference to FIGS. 3 and 5, the axial position of the connector shaft with respect to each of the openings can be seen in relation to the operation of the assembly. FIG. 3 shows the position of the second end portion extending entirely through the connector opening and second flange opening. In this release position, the tilt head will freely rotate.

Figure 7:
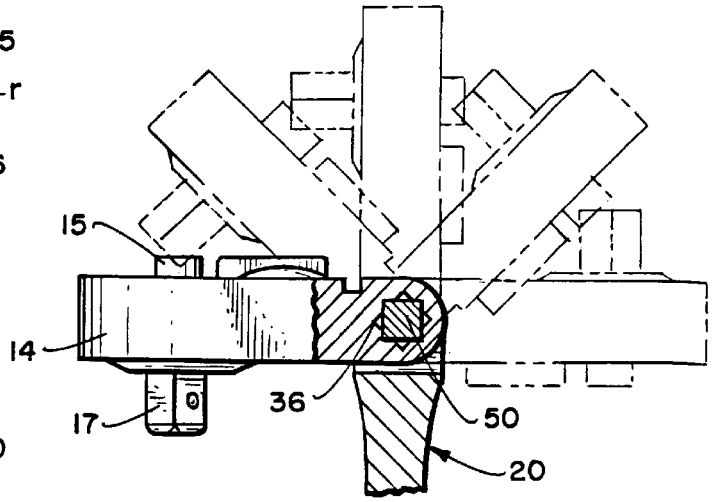
FIG. 7 is a view similar to FIG. 6 showing in phantom the different angular positions of the tilt head.
Figure 8:
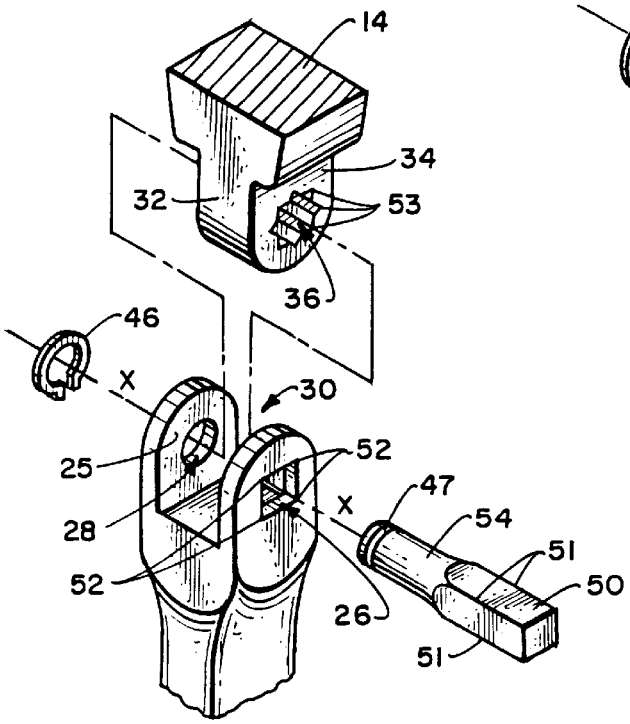
FIG. 8 is an exploded fragmentary perspective view of the wrench assembly shown in FIG. 2.

When the head is in the desired angular orientation, a user will exert axial force, as shown by arrow F in FIG. 5, to move the shaft into a lock position. This occurs when the first end portion extends through the first opening and into the connector opening. The second end portion will simultaneously be displaced out of the connector opening and into the second opening. This action will permit outside corners 51 to engage corresponding inside corners 52,53 of the first opening and connector opening. The tilt head is now locked into the desired angular orientation. As shown in FIG. 7, the above arrangement provides for multiple engagements about at least a 180° radius.

To effect the lock and release positions of the tilt head, the first end portion should have an axial length at least as long as the width of the first flange and an effective axial portion of the connector opening. This is necessary to simultaneously engage the geometrical configurations of both structures. It can also be seen that the second end portion can only provide a hinging function if it has a length that is no less than the width of the second flange and connector part. Although not shown, the assembly may include a biasing means to hold the head in a locked position. This could include a deflectable detent ball that engages a corresponding recess in the shaft or a conventional compression spring between snap ring 46 and the second flange.

Figure 9:
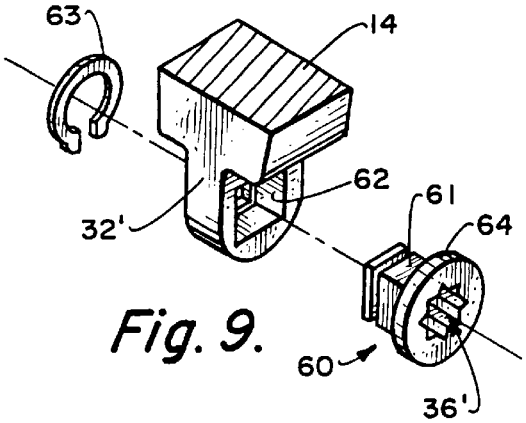
FIG. 9 is an exploded fragmentary perspective view of an alternative embodiment of the tilt head connector part showing use of a connector opening bushing.
Figure 10:
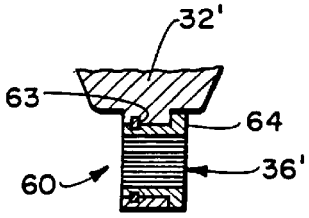
FIG. 10 is a fragmentary cross-sectional view showing the bushing depicted in FIG. 9 assembled into the connector part.

To provide a stronger and/or longer lasting wrench assembly, the connector opening may be provided with an optional replaceable bushing 60. As shown in FIGS. 9 and 10, the bushing includes a polygonal-shaped base 61 that engages a corresponding insert opening 62 in the connector part. The base extends into the insert opening and is locked at sidewall 35 with retainer ring 63. The bushing includes an enlarged hub 64 which, in conjunction with the retainer ring, serves to prevent axial movement of the bushing in either direction. When in place, the bushing provides a connector opening 36' in the same manner as described with respect to opening 36.

It will be appreciated that the advantages of the invention may also be realized when the connecting structures between the head and handle are reversed. An illustrative embodiment of this is shown in FIG. 11 wherein the proximal end of tilt head 70 is shown with an axially extending yolk. The yolk comprises a first head flange 71 and a second head flange 73. Each head flange is provided with a corresponding respective first head opening 72 and second head opening 74. Each head opening will have a different geometrical shape.

The proximal end of handle 75 is provided with terminal part 76 which is the functional equivalent of the previously described connector part 32. The terminal part includes an attachment opening 77. The attachment opening is the equivalent of connector opening 36 and may also be characterized as a third opening with a third geometrical shape. When the terminal end is fitted between the spaced-apart flanges, the center axis of each opening will be aligned to permit axial movement of connector shaft 40 in the same manner and for the same purposes as described hereinabove.

While the invention has been described with respect to preferred embodiments, it will be clear to those skilled in the art that modifications and improvements may be made to the invention without departing from the spirit and scope of the invention. Therefore, the invention is not to be limited by the specific illustrative embodiments, but only by the scope of the appended claims.

I claim:

1. A tilt head wrench comprising:

a handle having an attachment end with spaced-apart first and second flanges through which extend respective first and second openings, said first opening having a polygonal shape with inner corners and said second opening having a circular shape;

a tilt head connected to said attachment end by a hinge means, said tilt head having a connector part with a connector opening having a polygonal shape with respective inner corners;

said hinge means comprising a connector shaft which is axially slidable within said connector opening and said first and second openings, said shaft comprising a first end portion having a polygonal cross-sectional shape with outer corners and a second end portion having a circular cross-section, said first end portion having a longitudinal extent that is greater than the width of said first flange and less than the combined widths of said connector part and said first flange; said first end portion preventing rotation of said tilt head when positioned within said first opening and said connector opening, said second end portion permitting free rotation between said tilt head and attachment end when positioned within said second opening and said connector opening.

2. The wrench of claim 1 wherein the center axes of said first and second openings are in axial alignment and about perpendicular to the longitudinal axis of said handle.

3. The wrench of claim 2 wherein said tilt head includes a socket lug having a rotational axis which is about perpendicular to said center axes.

4. The wrench of claim 1 wherein said tilt head connector part is located between said first and second flanges and positioned so that the center axis of said connector opening is in axial alignment with the center axes of said first and second openings.

5. The wrench of claim 4 wherein each of said first and second flanges have an inside wall surface and said connector part includes opposing sidewalls having bearing faces each one of which engages a respective inside wall surface.

6. The wrench of claim 4 wherein said connector shaft includes a retention means proximate at least one opposing end of said shaft.

7. The wrench of claim 6 wherein the longitudinal extent of said connector shaft exceeds the combined widths of said first and second flanges and said connector part.

8. The wrench of claim 1 wherein said outer corners have sufficient radial extent to engage corresponding inner corners of said first opening and said connector opening.

9. The wrench of claim 1 wherein the longitudinal extent of said second end portion is not less than the combined widths of said connector part and said second flange.

10. A tilt head wrench comprising:

a wrench handle and tilt head joined together by a hinge means, the proximal end of either one of said handle or head having spaced-apart first and second flanges through which extend respective first and second openings, said first opening having a polygonal shape and said second opening having a circular shape;

the proximal end of the other one of said handle or head having a third opening with a polygonal shape;

said hinge means comprising a connector shaft which is reciprocable within said first and second openings and said third opening, said shaft having opposing first and second end portions, said first end portion having a longitudinal extent that is greater than the width of said first flange and less than the combined widths of said other one of said proximal ends and said first flange, said first end portion having a predetermined cross-sectional configuration that is sufficient in radial extent to engage portions of said first and third polygonal shapes when positioned within said first and third openings, said second end portion having a circular cross-sectional shape that permits free rotation between said head and handle when positioned within said second opening and said third opening.

11. The wrench of claim 10 wherein said first end portion has a polygonal cross-sectional shape that corresponds to said first and third openings.

12. The wrench of claim 11 wherein the connector shaft includes a retention means proximate at least one opposing end of said shaft.

13. A tilt head wrench comprising:

a handle having an attachment end with first and second spaced-apart flanges;

a polygonal shaped first opening extending through said first flange, said first opening including a plurality of inside corners defining a first opening diameter;

a circular shaped second opening extending through said second flange having a center axis that is coextensive with said first opening;

a tilt head having a connector part interfitted between said flanges, said connector part having a polygonal shaped connector opening with a center axis that is coextensive with the center axes of said flanges, said connector opening including a plurality of inside corners defining a connector opening diameter;

a shaft comprising a first portion and a second portion extending into said flange openings and said connector part opening, said first portion having a polygonal shaped cross-section with outside corners defining an outer diameter about equal to said first opening diameter and said connector opening diameter;

said second portion having a circular cross-section with a diameter about equal to the diameters of said second flange opening and said connector opening; and, said first portion having a length sufficient to extend through said first opening and into said connector opening when a predetermined length of said second portion is positioned within said second opening.

14. The wrench of claim 13 wherein each of said first and second flanges include an inside wall and said connector part includes opposing sidewalls having bearing surfaces each one of which engages a respective inside wall.

15. The wrench of claim 14 wherein said connector opening is defined by an apertured bushing-extending into said connector part.

16. The wrench of claim 13 wherein said first opening diameter and said connector opening diameter are about equal.

* * * * *